US011052294B2

(12) United States Patent
Carter

(10) Patent No.: US 11,052,294 B2
(45) Date of Patent: Jul. 6, 2021

(54) GOLF CLUB WITH ADJUSTABLE CENTER OF GRAVITY HEAD

(71) Applicant: SUMITOMO RUBBER INDUSTRIES, LTD., Kobe (JP)

(72) Inventor: Vandette B. Carter, Yorktown Heights, NY (US)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

(21) Appl. No.: 16/773,174

(22) Filed: Jan. 27, 2020

(65) Prior Publication Data

US 2020/0261776 A1 Aug. 20, 2020

Related U.S. Application Data

(60) Division of application No. 15/645,850, filed on Jul. 10, 2017, now Pat. No. 10,543,406, which is a division of application No. 12/050,127, filed on Mar. 17, 2008, now Pat. No. 9,700,764, which is a continuation-in-part of application No. 11/833,970, filed on Aug. 3, 2007, now abandoned.

(Continued)

(51) Int. Cl.

| | |
|---|---|
| ***A63B 53/06*** | (2015.01) |
| ***A63B 53/04*** | (2015.01) |
| ***A63B 60/00*** | (2015.01) |

(52) U.S. Cl.

CPC ..... *A63B 53/0466* (2013.01); *A63B 53/047* (2013.01); *A63B 60/00* (2015.10); *A63B 53/0408* (2020.08); *A63B 53/0433* (2020.08)

(58) Field of Classification Search

CPC . A63B 2053/0491; A63B 53/06; A63B 60/02; A63B 60/04

USPC ..... 473/324–350

See application file for complete search history.

(56) References Cited

U.S. PATENT DOCUMENTS 2,028,291 A * 1/1936 Macpherson ..... A63B 59/55 473/519

3,199,874 A * 8/1965 Blasing ..... A63B 53/04 473/244

(Continued)

FOREIGN PATENT DOCUMENTS

JP 01043278 A 2/1989

JP 06238022 A * 8/1994

(Continued)

*Primary Examiner* — Alvin A Hunter

(74) *Attorney, Agent, or Firm* — Oliff PLC

(57) ABSTRACT

A golf club having a head with a series of tracks forming a three-dimensional pattern; weights for positioning along channels; and a mechanism for securing the weights at positions along the channels so as to customize center of gravity and moment of inertia. The channels can all interconnect to allow a weight to be moved from one to another. The club can include a removable cover for at least a portion of the surface to cover the channels and the weights. The weights can comprise a spherical member disposed in a channel; a member external to a surface of the head; and a coupling between the spherical member and the external member to allow the spherical member and the external member to capture between them a wall in which a track is formed. The channels may be in the removable cover, or below the removable cover, in the head.

9 Claims, 16 Drawing Sheets

Related U.S. Application Data

(60) Provisional application No. 60/835,048, filed on Aug. 3, 2006.

(56) References Cited

U.S. PATENT DOCUMENTS 5,244,210 A 9/1993 Au
5,518,243 A * 5/1996 Redman ..... A63B 60/00 473/334
5,688,189 A * 11/1997 Bland ..... A63B 53/065 473/314
5,720,674 A * 2/1998 Galy ..... A63B 53/0466 473/345
5,769,737 A * 6/1998 Holladay ..... A63B 53/06 473/336
5,911,638 A 6/1999 Parente et al.
5,916,042 A * 6/1999 Reimers ..... A63B 53/0466 473/334
5,971,867 A * 10/1999 Galy ..... A63B 53/04 473/345
6,015,354 A * 1/2000 Ahn ..... A63B 53/0466 473/256
6,277,032 B1 * 8/2001 Smith ..... A63B 53/0466 473/336
6,361,451 B1 * 3/2002 Masters ..... A01K 87/00 473/318
6,394,909 B1 * 5/2002 Laibangyang ..... A63B 60/16 473/232
6,440,009 B1 * 8/2002 Guibaud ..... A63B 53/04 473/334
6,575,854 B1 * 6/2003 Yang ..... A63B 53/00 473/519
7,108,609 B2 * 9/2006 Stites ..... A63B 60/00 473/256
7,147,573 B2 * 12/2006 DiMarco ..... A63B 53/0466 473/324
7,166,041 B2 * 1/2007 Evans ..... A63B 53/0466 473/334
7,452,286 B2 * 11/2008 Lin ..... A63B 60/02 473/334
7,520,820 B2 * 4/2009 Dimarco ..... A63B 60/00 473/334
7,611,424 B2 * 11/2009 Nagai ..... A63B 60/52 473/334
7,775,905 B2 * 8/2010 Beach ..... A63B 53/06 473/334
7,857,707 B2 * 12/2010 Beppu ..... A63B 53/00 473/256
7,871,334 B2 * 1/2011 Young ..... A63B 53/0466 473/231
7,871,335 B2 * 1/2011 Young ..... A63B 53/06 473/231
7,914,403 B2 * 3/2011 Ie ..... A63B 59/70 473/563
7,976,400 B1 * 7/2011 Pottorff ..... A63B 60/00 473/248
8,202,175 B2 * 6/2012 Ban ..... A63B 60/02 473/338
8,444,502 B2 * 5/2013 Karube ..... A63B 53/007 473/297
8,444,505 B2 * 5/2013 Beach ..... A63B 53/0466 473/334
8,556,756 B2 * 10/2013 McClung ..... A63B 60/00 473/519
8,702,530 B2 * 4/2014 Slaughter ..... A63B 53/00 473/297
8,734,271 B2 * 5/2014 Beach ..... A63B 60/00 473/334
8,840,487 B2 * 9/2014 Okot ..... A63B 53/0466 473/306
8,870,678 B2 * 10/2014 Beach ..... A63B 60/00 473/334
9,067,107 B2 * 6/2015 Solhaug ..... A63B 53/00
9,211,453 B1 * 12/2015 Foster ..... A63B 60/04
9,259,627 B1 * 2/2016 Myers ..... A63B 53/04
9,278,262 B2 * 3/2016 Sargent ..... A63B 53/02
9,364,728 B1 * 6/2016 Myers ..... A63B 60/02
9,700,764 B2 * 7/2017 Carter ..... A63B 53/0466
10,173,111 B2 * 1/2019 Busch ..... A63B 53/065
10,543,406 B2 * 1/2020 Carter ..... A63B 53/047
10,596,428 B1 * 3/2020 Rumble ..... A63B 53/06
10,843,053 B2 * 11/2020 Carter ..... A63B 53/0433
2004/0242343 A1 12/2004 Chao et al.
2006/0105856 A1 5/2006 Lo
2006/0122004 A1 * 6/2006 Chen ..... A63B 53/0466 473/335
2006/0172821 A1 8/2006 Evans
2006/0178228 A1 * 8/2006 DiMarco ..... A63B 60/02 473/334
2006/0240908 A1 * 10/2006 Adams ..... A63B 60/52 473/334
2007/0178988 A1 * 8/2007 Tavares ..... A63B 53/04 473/334
2007/0265108 A1 * 11/2007 Lin ..... A63B 53/0466 473/334
2007/0287555 A1 12/2007 Kawaguchi et al.
2008/0020857 A1 1/2008 Cackett et al.
2008/0020861 A1 * 1/2008 Adams ..... A63B 53/04 473/334
2008/0039228 A1 * 2/2008 Breier ..... A63B 53/04 473/334
2008/0194354 A1 * 8/2008 Nagai ..... A63B 60/52 473/334
2008/0261715 A1 * 10/2008 Carter ..... A63B 60/00 473/291
2009/0203463 A1 * 8/2009 DiMarco ..... A63B 53/0466 473/334
2009/0215551 A1 * 8/2009 Liang ..... A63B 53/06 473/335
2010/0075773 A1 * 3/2010 Casati, Jr. ..... A63B 60/02 473/334
2010/0144461 A1 * 6/2010 Ban ..... A63B 60/02 473/338
2011/0053705 A1 * 3/2011 Stites ..... A63B 53/0466 473/334
2012/0058838 A1 * 3/2012 Stites ..... A63B 60/02 473/334
2014/0038746 A1 * 2/2014 Beach ..... A63B 53/0466 473/335
2016/0129323 A1 * 5/2016 Myers ..... A63B 53/0466 473/338

FOREIGN PATENT DOCUMENTS

JP 2004351154 A * 12/2004
JP 2005296582 A * 10/2005
JP 2005323978 A * 11/2005
JP 2006198385 A * 8/2006
JP 2006223788 A * 8/2006
JP 2006239351 A * 9/2006
JP 2006288882 A * 10/2006
JP 2006320493 A * 11/2006
JP 2008194454 A * 8/2008 ..... A63B 53/0466
JP 2009172130 A * 8/2009
WO WO-2007023591 A1 * 3/2007 ..... A63B 53/065
WO WO-2007044220 A1 * 4/2007 ..... A63B 53/047

* cited by examiner

GOLF CLUB WITH ADJUSTABLE CENTER OF GRAVITY HEAD

This application is a divisional of Ser. No. 15/645,850 issued as U.S. Pat. No. 10,543,406, which is a divisional of Ser. No. 12/050,127, issued as U.S. Pat. No. 9,700,764, which is a continuation-in-part of application Ser. No. 11/833,970 filed on Aug. 3, 2007, abandoned, which claims priority under 35 U.S.C. § 119(e) from U.S. Provisional Patent Application Ser. No. 60/835,048 filed on Aug. 3, 2006, which applications are all incorporated herein by reference in their entireties, for all purposes.

BACKGROUND OF THE INVENTION

Field of the Invention

The present invention relates to golf clubs. More particularly, it relates to a scalable—unconventional approach for adjusting the weight distribution within a golf club's head, particularly a driver, fairway woods, iron or putter.

Background Art

The USGA governing body has allowed for the adjustments of weights within a golf club's head as part of fulfilling the criteria of approved conforming golf clubs. Many manufacturers have resorted to a very basic approach to capitalize on the advantage of adjusting the center of gravity (COG) within a club's design by simply interchanging 'nuts and bolts' on the golf club's head or affixing weights in areas of advantage in the club head.

The problem with these approaches is that each time a user desires to adjust the COG within his club's design, the player must remove weighted elements from the club to do so or select a different club, which has a different playing characteristic. The former calls for the replacement or substitution of the removed parts in order to "guesstimate" the COG. Despite best effort, the COG variations are limited in both scenarios and determined by the finite number of nuts and bolts available for a particular club or manner in which the weights can be adjusted, added or subtracted. Moreover the removal of these nuts and bolts are time consuming, require specialized tools and calls for exhausting trial and error before the desire results can be achieved. When an undesired effect is appreciated, the player must tackle the golf club numerous times by interchanging a multiplicity of 'nuts and bolts' as before, carefully recalling 'what goes where' etc.

In other examples, manufacturers have created open "burrows" confined to the sole of the club head and have utilize a two dimensional (2D) approach to adjust the COG in that location only. Moreover, a single port of entry and exit to add and subtract weights to the club head can be seen in, for example, United States Patent Publication 2006/0122004 of Chen et al. Further the "burrows" are left opened to the elements thereby potentially affecting the club's functionality during play. For example, debris can become stuck in a part of the "burrow' which may affect the club's COG to some degree. These limitations mentioned here and to be mentioned later are all considered to be drawbacks for a versatile golf club, which adheres stringently to the USGA's rule.

U.S. Pat. No. 6,015,354 to Ahn et al. teaches a method to change the weight of a golf club's head to affect the COG. In Ahn et al., the removal and replacements of weights are stressed in all the cases, and the weights move across a two-dimensional plain as in the prior example.

In United States Patent Publication No. 2004/0242343, Chao et al. describe a method of interchanging and substituting weights within a golf club's head. The mass is generally changed when this is done. As before, the invention is limited in its design and function. Weights can only be fixed into a predetermined location and their removal is required for adjustments of the COG with the use of specialized tools. The position of the COG is severely restricted by this very basic approach. Moreover a multiplicity of weights cannot be removed or substituted at the same time.

In United States Patent Publication No. 2006/0122004, Chen et al. describe a method for placing weights in a "trough" located in the "back" of a club head, having a "larger width" and "insertion hole." This approach limits the true dynamics of achieving versatile center of gravity, aesthetics or the ability to position the club's weight in a location of appreciable benefits; such as on the complexed countoured surface of the sole (without thickening the club) or along the outer perimeter of the club's head, which when achieve greatly maximizes the club's performance and versatility. As noted before there is a Single limited access (port of entry) for weight addition and removal at any given time. Moreover the weight is confined to a two-dimensional plain; has more than two components and locks using a pressure expansion-contraction system which secure the weights into the depths of the club volume, instead of outwards, and towards the surface or perimeter. These features do not ensure reliable performance and may pose a danger or liability if broken or snapped during play. A noticeable drawback once again is that it takes a considerable amount of time to modify the COG in the likes of Chen, Ahn and Chao et al.

SUMMARY OF THE INVENTION

It is an object of the invention to provide a golf club with an adjustable center of gravity, moment of inertia and variable equilibrium.

It is another object of the invention to permit the substitution of a given set of weights as a group instead of individually. A further objective is to have a given number of weights permanently fixed to the club's head, thereby negating the need to substitute weights, and thus maintaining a constant, fixed mass. The club's center of gravity is adjustable simply by relocating the number of given weights along a given three dimensional (3D) path/track or tracks, affecting its center of gravity and moment of inertia.

Weights maybe configured within a cover. Removal of one or more weights can take place simultaneously (to affect the MOI/COG) by simply removing the cover located on at least part of the surface of the golf club head, and replacing the cover with another cover with different weight placement, but optionally, with the same total weight.

The present invention overcomes these inconveniences and promotes advancements by providing a way to conform to the USGA rule by making the golf club "plain in design" while honoring USGA rule #4 c by providing an option to allow the golf club's weights to be easy to adjust during training, but difficult to manipulate during regulation play; individual weight can be adjusted with the use of a coin or divot in one of several embodiments.

A relatively plain cover is provided which will prevent improper movement during regulation play in one of several embodiments. Weights can be added to the golf club's head by removing the cover plate from the club's head/body, allowing easy access to the tracks to then add or subtract one or more weights simultaneously or individually.

Another object and further enhancement of the invention is to provide a golf club, which is literally "plain in shape" as per USGA rules 4. In so doing, a smooth finish cover, made of opaque, translucent or transparent material, is provided to fit over the sole or perimeter in a complimentary way without adding or taking away from the club's overall shape. This cover may serve as a protection from the elements for the moveable weights and which can be securely and semi-permanently or permanently fixed to the golf club's body by a specially designed screw or lock mechanism that requires specialized tools for removal as dictated by the USGA.

In other embodiment of the invention classified as drivers and woods a series of separate or interconnecting recesses may be created in the sole of the club head in a three dimensional configuration. Individual spherical weights may be placed in each of the recesses and may be secured and protected by a cover as described. The cover may have slits to allow for the spheres to be further secured thereto by a frictional means along any given point of the recess. In so doing, the weights are not secured into the recesses and restricted to finite locations as seen in Chen & Chao et al.; instead they are levitated and secured onto the removable cover/sole of the club head.

In additional embodiments for the driver variety of the invention, the recesses for the weights are incorporated into the sole of the removable cover, situated at least partially on the sole of the club head. As before in the second embodiment, slits are provided to allow easy access and manipulation of the underlying spherical weights to be adjusted in a three dimensional orientation, close to the surface of the club.

Other clubs within the golfer's array of approved (hybrids) or non-conforming clubs may be fashioned by design to incorporate the benefits of this invention. Henceforth, a putter or an iron or fairway woods or hybrid club can be designed to have moveable weights according to the scope of this invention.

Innovations specific for the so call irons and putter may have weights movable behind the club face and linked to the club handle via a cable, rod, axle or hydraulic means. By inserting a specialize key into the top of the golf club handle, the weights can be adjusted toward the heel or toe using such means coupled with a compressible and expandable spring member or members engineered to effect movement of the weight.

Further, the back or the club face may have a transparent or translucent cover to reveal at least a portion of the movable weight located in the head structure.

In another embodiment, the club shaft maybe removed from the hosel and the movement of the weight in the club head maybe accessed from within the hosel by turning the cable, rod, "worm" or using a hydraulic mechanism to move the weight towards the heel or forward to the toe of the club head.

Further, the club shaft can be engineered to affect the movement of weights as described. For example the shaft can be made to turn clockwise or anticlockwise or pushed up or down to affect the movement of the weights in the club head as described.

Yet still in other embodiments, the weights maybe accessed from the heel or toe region of the golf club head In accordance with the invention, golf club heads are provided with a scalable systems of weights which allows for a precision and convenient adjustment of the COG without having to remove, switch or change weights from a golf club's head, or change the club's orientation to access the weights in the club head.

The invention is an advanced golf club technology, which allows the movement of weights in three dimensions, that is, across a three dimensional surface, having complex slopes or curves. Moreover, the tracks or recesses, which house the movable weights, can be in a plate or cover which is detachable from the club head. The tracks can be designed to be connected to each other or separated as individual entities.

The removable plate structures is preferably designed for the sole and perimeter portion of the golf club, even though it can be fabricated for the entire club surface.

To traverse the complex contours of a golf club's head, the weights can have the shape of a sphere or globe, coupled with a screw member of various designs and finishes. The weight can have a biasing knob member, which limits its ability to turn left, right, up or down to approximately 90 degrees.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
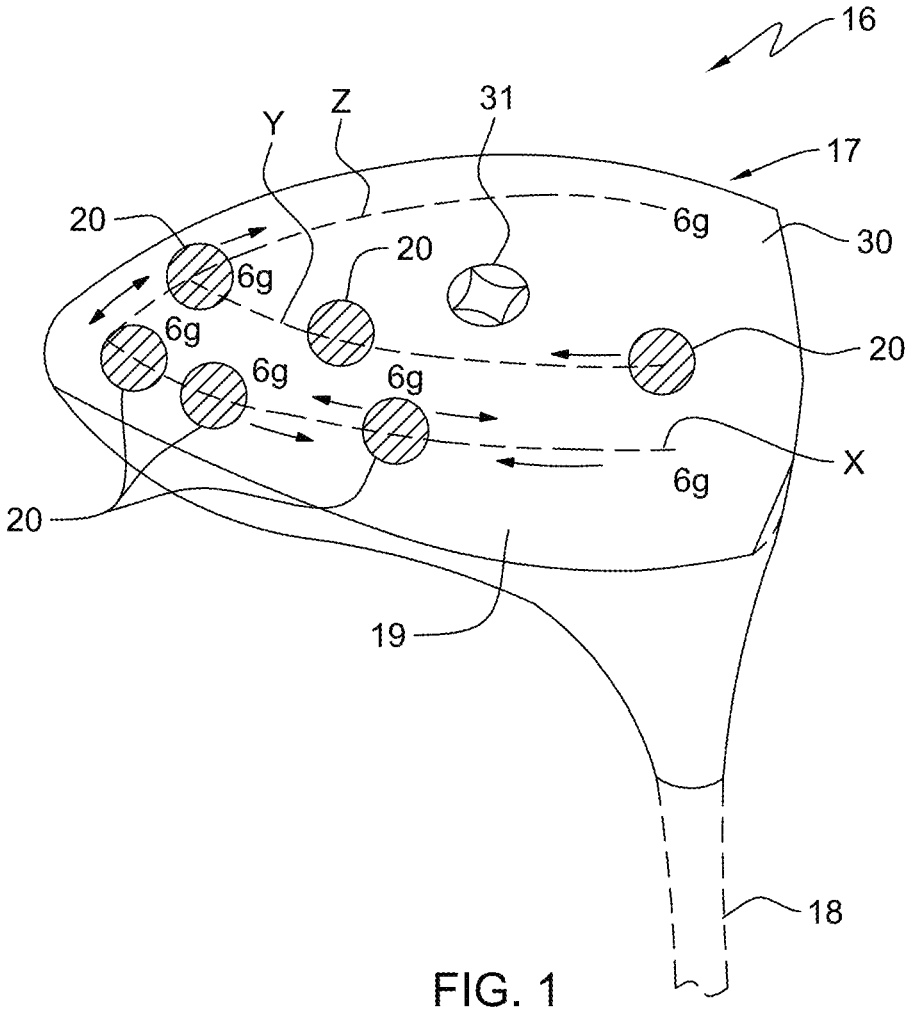
FIG. 1 is a prospective view of one embodiment of a golf club in accordance with the invention.

Referring to FIG. 1 there is shown a perspective view of a golf club 16 having a head 17 and a shaft 18, incorporating features of the present invention. Although the present invention will be described with reference to the embodiments shown in the drawings, it should be understood that the present invention can be embodied in many alternate forms of embodiments. In addition, any suitable size, shape or type of elements or materials could be used. The type of golf club illustrated in FIG. 1 is a generally referred to as a "wood", and has a lower surface or sole 19.

In accordance with general scheme of the invention, an interconnected series of tracks X, Y and Z define passageways for a movable series of weights each designated as 20, which may be positioned along tracks X, Y and Z. Each weight 20 may have a mass of, for example, 6 grams. The series of tracks X, Y and Z follows the contour of sole 19, and in general, defines a three-dimensional contour. Thus, not only can the weights be moved from one track to another, but they can be moved in three dimensions due to the three-dimensional nature of the tracks. While more weights may be added, it is preferable that the total mass be constant, and that the positions of the weights 20 be adjustable.

Figure 2:
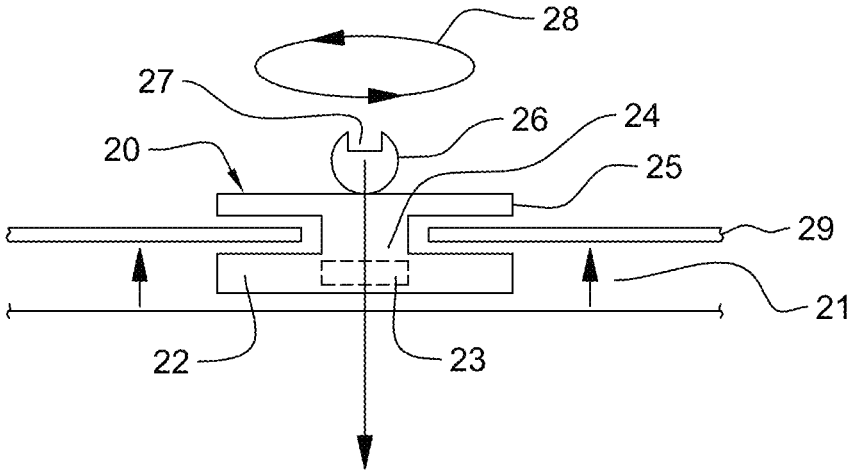
FIG. 2 is a simplified, cross-sectional schematic view taken through the golf club of FIG. 1, showing a weight.

Referring to FIG. 2, each of tracks X, Y and Z has associated with it a channel 21 in which a lower portion 22 of weight 20 is disposed. Portion 22 is configured with a threaded blind hole 23 for receiving a mating threaded extension portion 24 of an upper portion 25 of weight 20. Upper portion 25 may also have protruding slightly from it a generally spherical portion 26 having a slot 27 for receiving a tightening tool, such as a screwdriver (not shown), for rotating upper portion 25 with respect to lower portion 22, as represented by circle 28 to grip between them outer layer 29 of sole 19, thereby securing weight 20 against unwanted movement along a track, but permitting it to be released for placement at a different position along a track. It will be understood that the upper surface of lower portion 22 may be treated with a non-skid material, or have some covering so that when in contact with the inner surface of outer layer or wall 29 of sole 19, it is prevented from easily moving, therefore facilitating tightening by rotating spherical portion 26.

Figure 3:
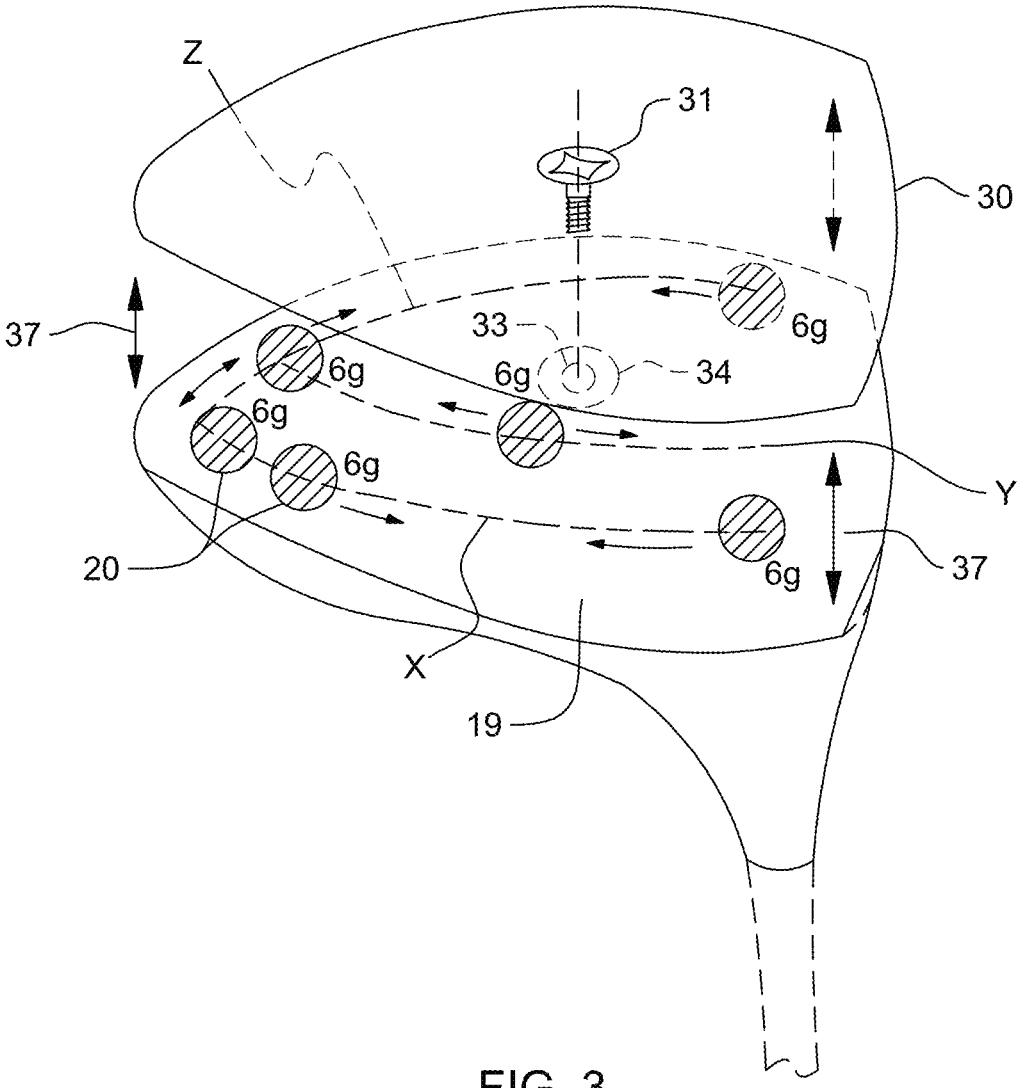
FIG. 3 is a partially exploded view of a golf club of FIG. 1, with the cover removed.

Referring to FIG. 1 and FIG. 3, a cover 30 is advantageously contoured to fit over sole 19, and is secured to head 17 by a securing mechanism 31, such as a screw 32 having a head 33 designed to be turned by a specialty tool (not shown). The end of screw 32 is received in a threaded hole 33 in a recess 34. Cover 30 may be formed from a transparent engineering plastic, such as a polycarbonate, thus allowing the user of golf club 16, or any other interested individual, to observe the positions of weights 20, and to verify, if desired, that they have not moved from a previously set position. Cover 30 is placed on and removed from head 19 in the directions illustrated by arrows 37.

Figure 4:
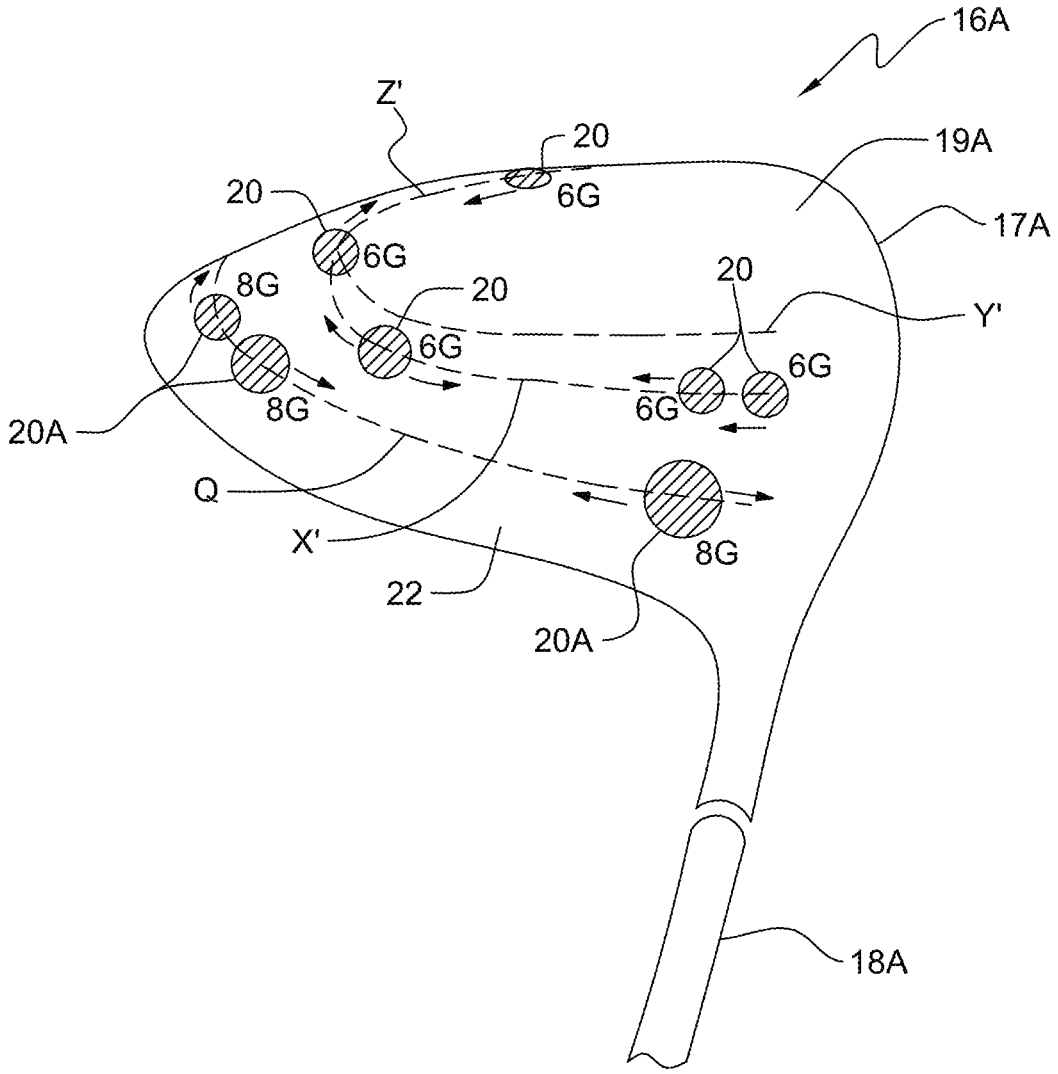
FIG. 4 is similar to FIG. 1, but illustrates a different track configuration on the perimeter and sole.

FIG. 4 illustrates another embodiment of the invention, wherein like components have reference numerals as in FIG. 1 and FIG. 3, but with the suffix "A". This embodiment has a series of interconnected tracks X', Y' and Z', as well as an additional track Q. Track Q may extend parallel to the periphery of sole 19A of head 17A, in the illustrated embodiment has three eight gram weights 20A, which may be positioned along its length.

Figure 5:
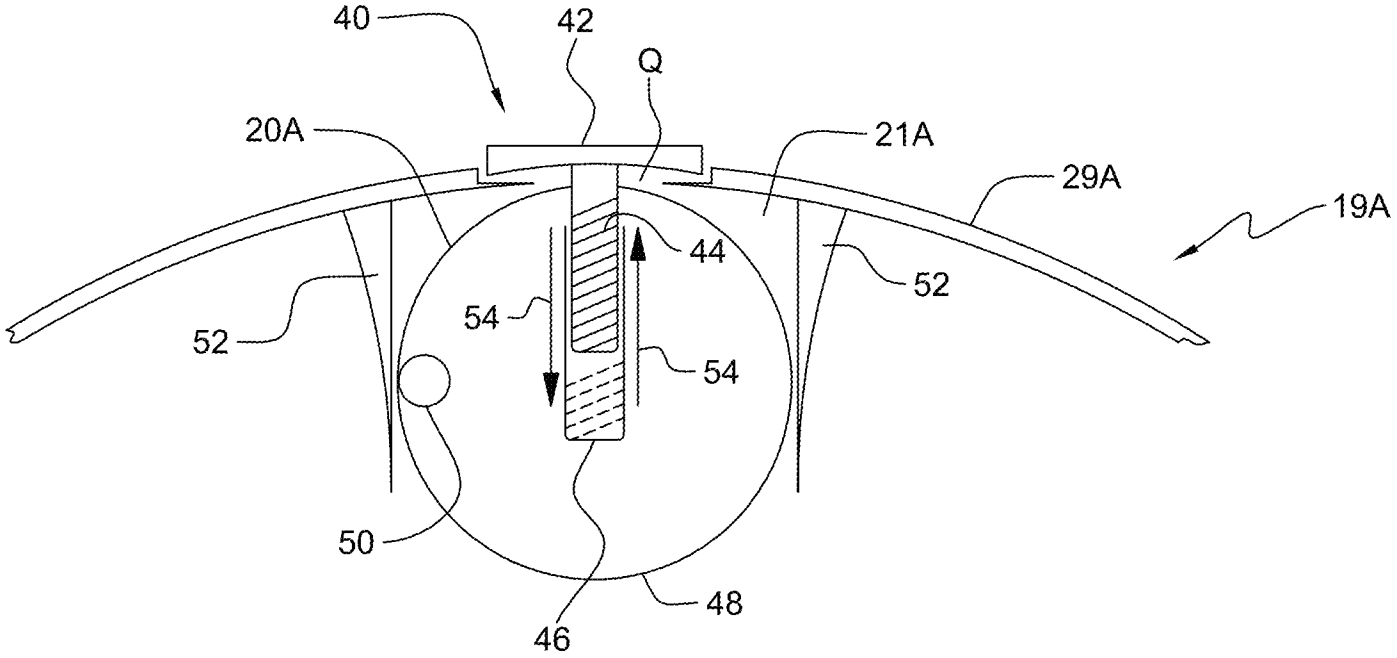
FIG. 5 is an enlarged, detailed schematic cross-sectional view of a portion of the 3D weight showing surface orientation.

FIG. 5 illustrates another possible configuration for the weights 20 or 20A. Like components have reference numerals as in FIG. 2, but with the suffix "A". A screw 40 has a head 42 and a threaded portion 44 that extends into a mating threaded blind hole 46 in a spherical mass 48 (having a diameter of, for example, 1.0 cm and formed of a metal; lead, tungsten, iron or steel), which fits within a channel 21A associated with a track such as track Q. Mass 48 is prevented from turning within channel 21A more than a limited amount by a spherical protrusion 50 that hits the walls 52 of channel 21A. Head 42 may be caused to rotate by a suitable tool (not shown in FIG. 5) causing screw 40 to move into and out of mass 48, as represented by arrows 54. The outer layer or wall 29A of sole 19A may have a thickness of approximately 0.4 mm.

The configuration of FIG. 5 has the advantage, due to the spherical nature of mass 48, of providing sufficient clearance from the wall of a channel to allow weights 20A to be positioned along tracks in convex or concave surfaces.

Figure 6:
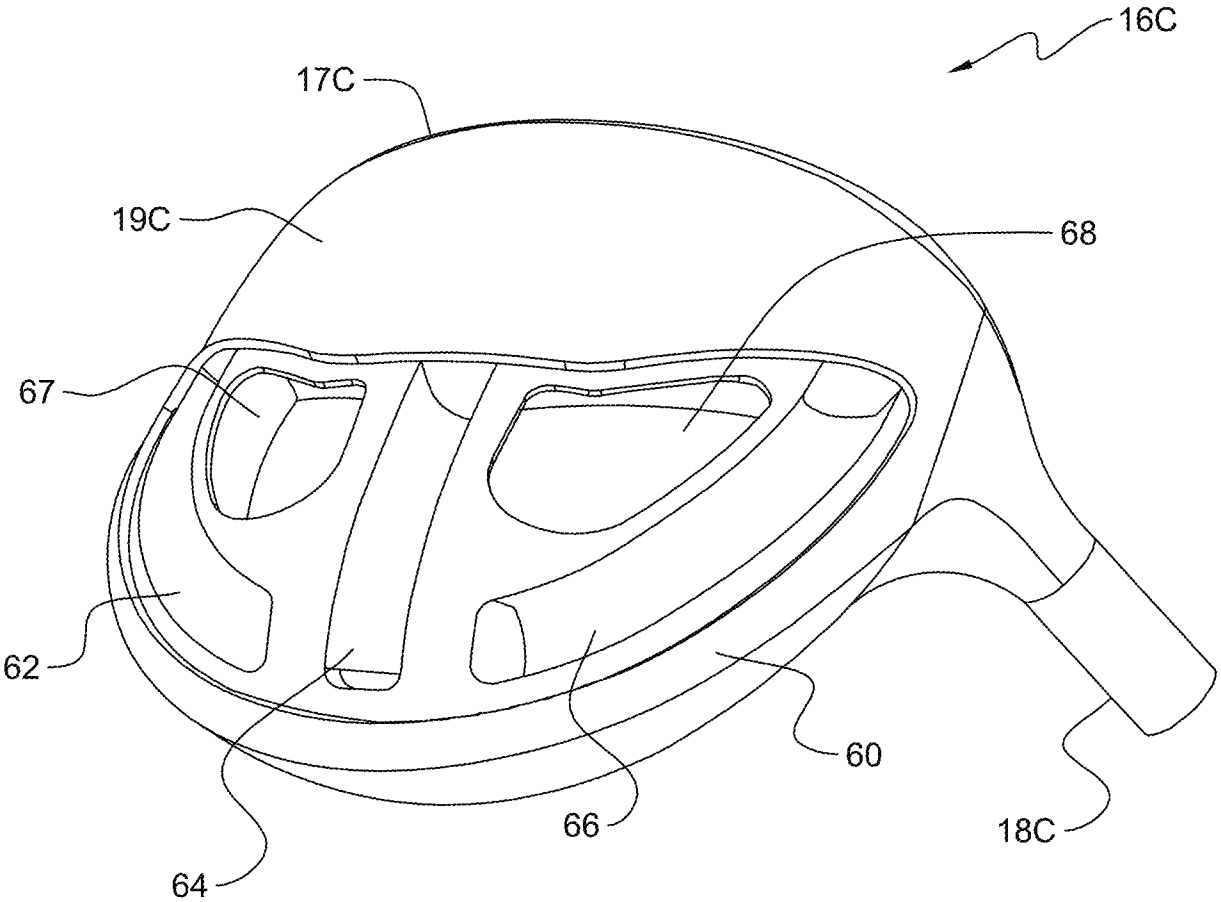
FIG. 6 is an enlarged, perspective view of another embodiment of the invention, showing three dimensional track in the club head.
Figure 7:
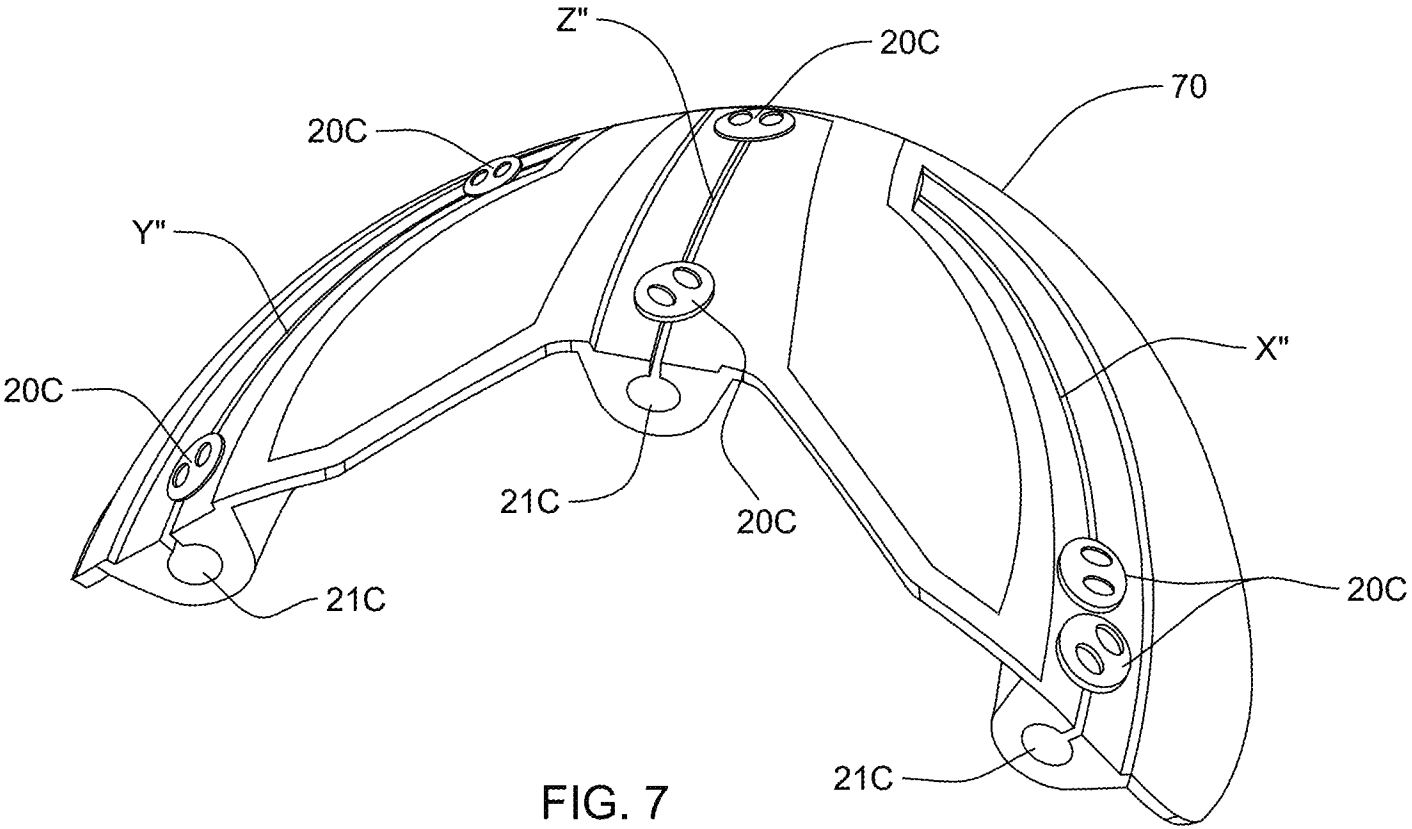
FIG. 7 is an enlarged, perspective view of a cover with tracks for the embodiment of the invention of FIG. 6.

Referring to FIGS. 6 and 7, another embodiment of the invention is illustrated wherein like components have reference numerals as in FIG. 1 and FIG. 3, but with the suffix "C". Instead of receiving movable weights directly within the body of head 17, as in FIG. 1, weights 20C are received in tracks X", Y" and Z" of a cover 70 (FIG. 7) for a portion of the sole 19C of head 17C. The outer periphery of cover 70 is received in a slight recess 60 in sole 19C. Lower portions of weights 20C are received in channels 21C defined in thicker portions of cover 70 associated with tracks X", Y" and Z". These thicker portions are received in channels 62, 64 and 66 in head 17C, when cover 70 is placed on head 17C (FIG. 6). If necessary or permitted by appropriate rule, recesses 67 and 68 may be filed with an appropriate material of a density needed to provide a specific weight.

Figure 8:
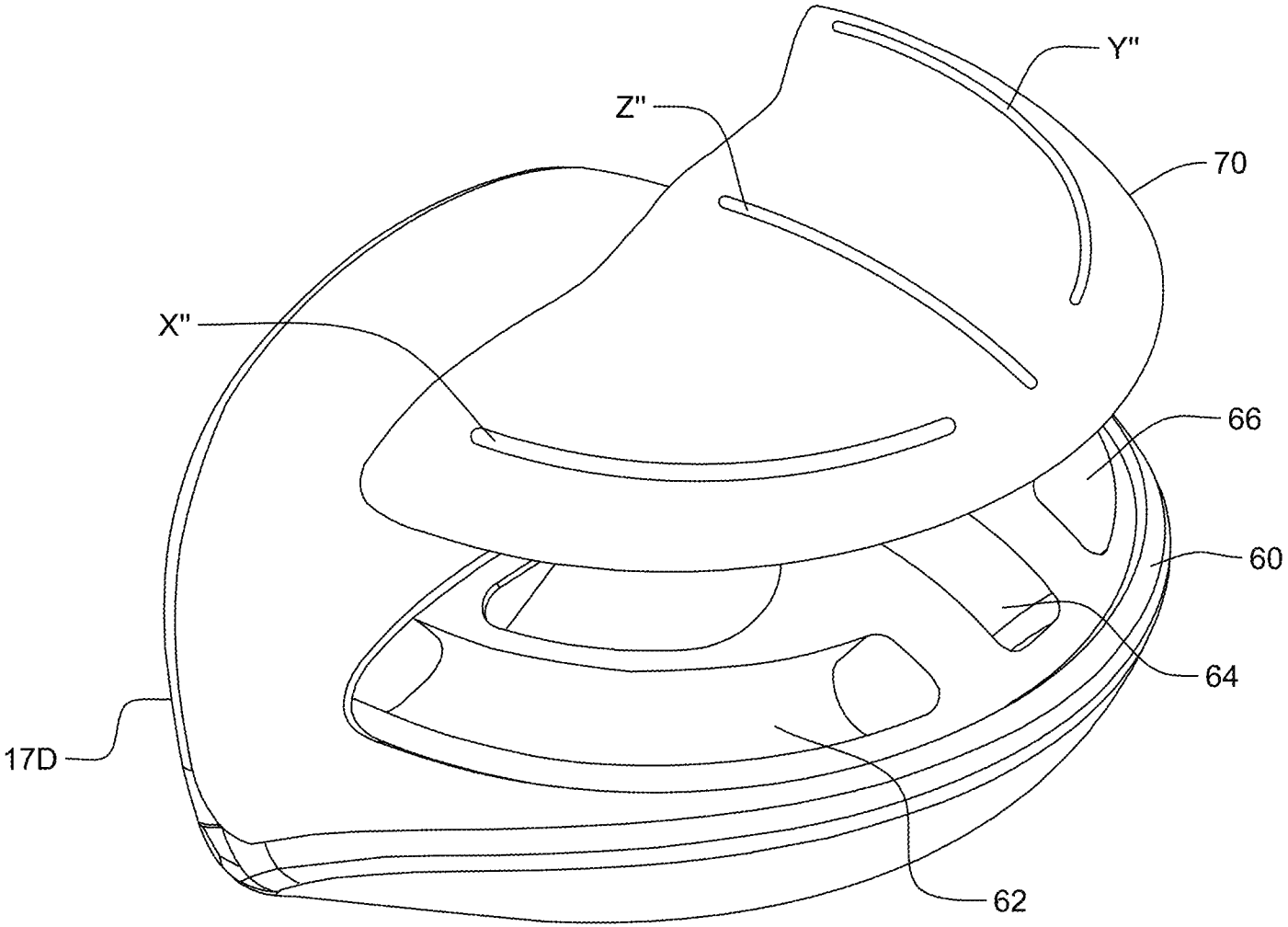
FIG. 8 is an exploded view showing a cover with slit in the tracks.
Figure 9:
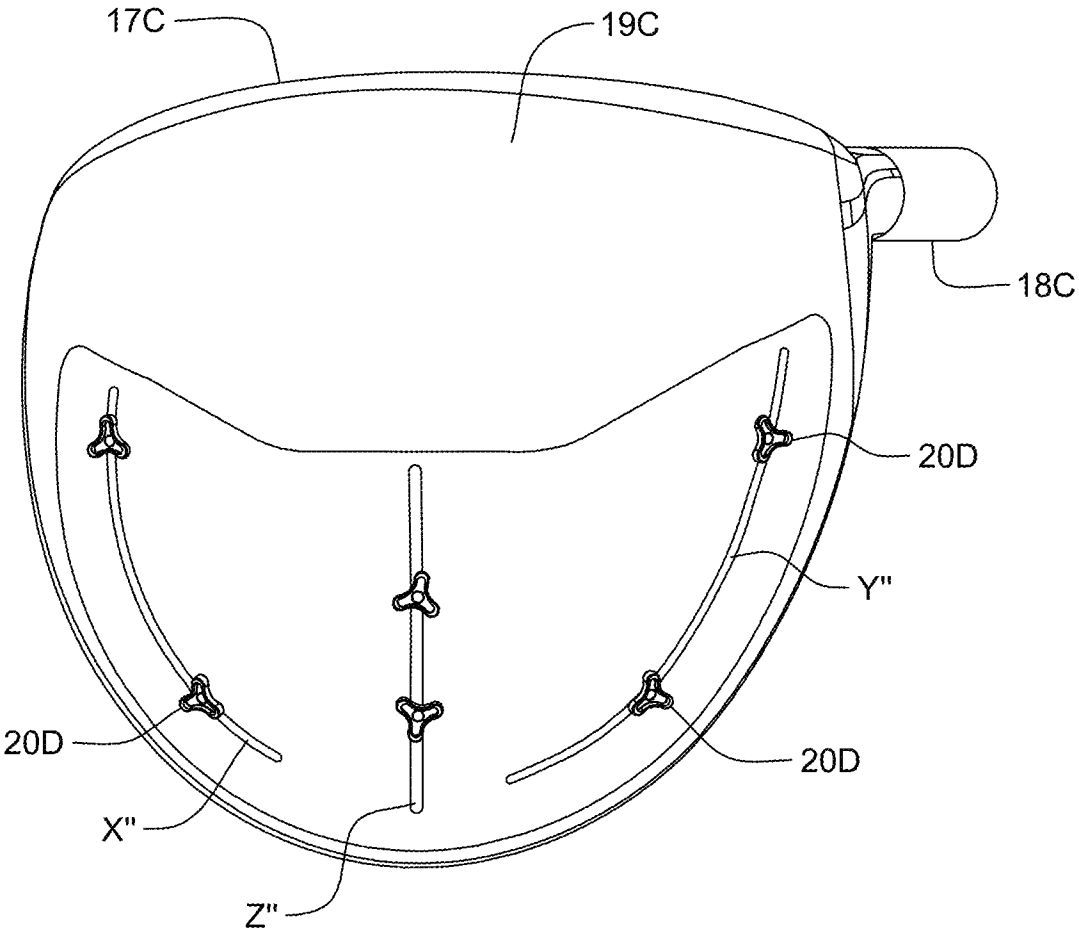
FIG. 9 is a plan view of the embodiment of FIG. 8, with the cover of FIG. 8 in place and with weights.
Figure 9A:
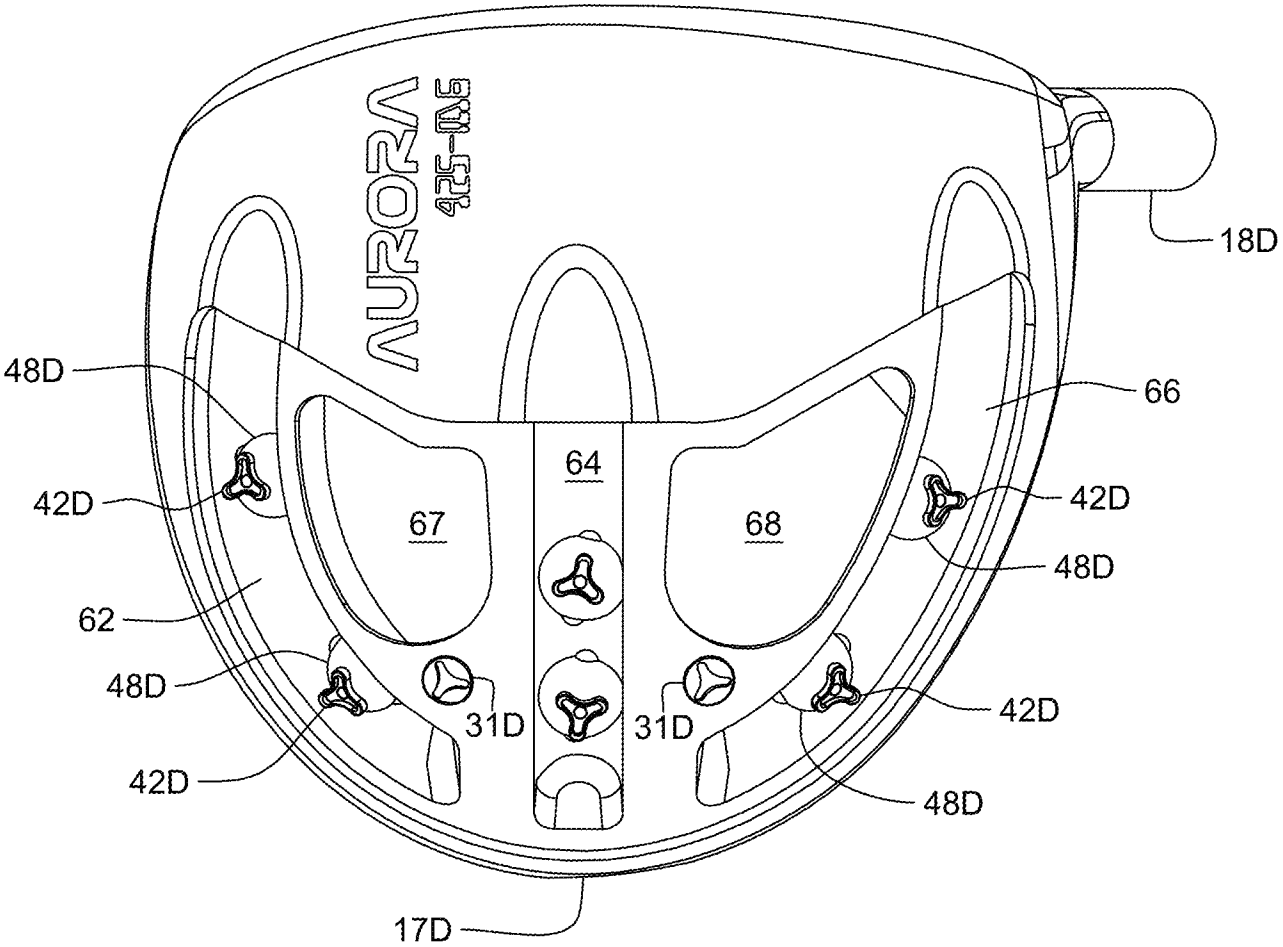
FIG. 9A is a plan view similar to FIG. 9, with the cover removed and the weights in place.

Referring to FIGS. 8, 9 and 9A, wherein like components have reference numerals as in FIG. 1 and FIG. 3, but with the suffix "D", in a preferred embodiment, weights may be configured as in FIG. 5, wherein screws have heads 42D and a threaded portion that extends into a mating threaded blind hole in a spherical mass 48D (having a diameter of, for example, 1.0 cm and formed of tungsten or steel), which fits within one of channels 62, 64 and 66, formed in head 17C, when cover 70 is placed on head 17D, as illustrated being placed, and placed thereon in FIGS. 8 and 9, respectively. Hollow recess 67 and 68 may be provided in head 17C to provide proper weight. Again, if necessary or permitted by appropriate rule, recesses 67 and 68 may be filed with an appropriate material of a density needed to provide a specific weight.

Figure 17A:
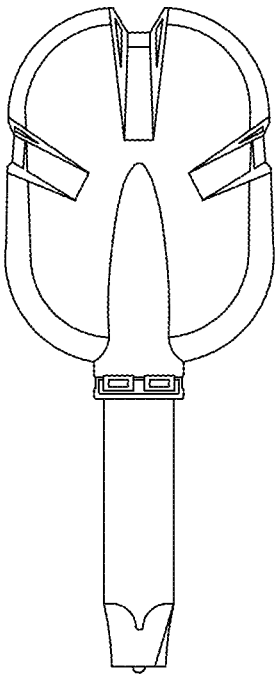
FIGS. 17A, 17B and 17C are views of a weight adjusting key for a screw head of a weight in accordance with the invention.
Figure 17B:
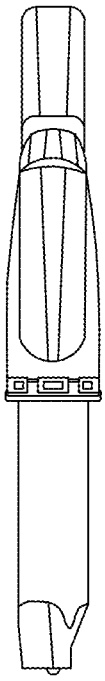
Figure 17C:
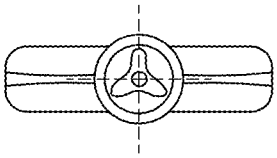

The heads 42D of the screws for the weights may be turned by a specialty tool for purposes of loosening the screws to allow movement and tightening the screws to fix weights 20C in place, as discussed above. A different tool or key, having three prongs at its end, as illustrated in FIGS. 17A, 17B and 17C may be used for the different heads of weights 20D of the embodiment of FIGS. 9 and 9A. The cover 17D may be secured to head 17D by securing mechanisms 31D similar to 31 of FIGS. 1 and 3, as described above.

The embodiments of the invention described with respect to FIG. 6 to FIG. 9 have a major advantage. A golfer may adjust the position of the weights, and then remove the cover, and replace it with another cover with the weights secured in different positions. Thus, if the golfer has several favorite configuration of weights for specific positions of the COG, of specific moments of inertia, each cover, and its associated weights can effectively "store" that information, without the golfer having to laboriously reposition the weights, which can lead to inaccuracy in positions, and the need for much trial and error, until a favorite configuration is re-established. It is even possible for a golfer using a set of clubs in accordance with the invention, that are not the golfer's own, to simply bring along a cover with weights appropriately positioned, and to install the cover prior to beginning a game or practice session.

Figure 10:
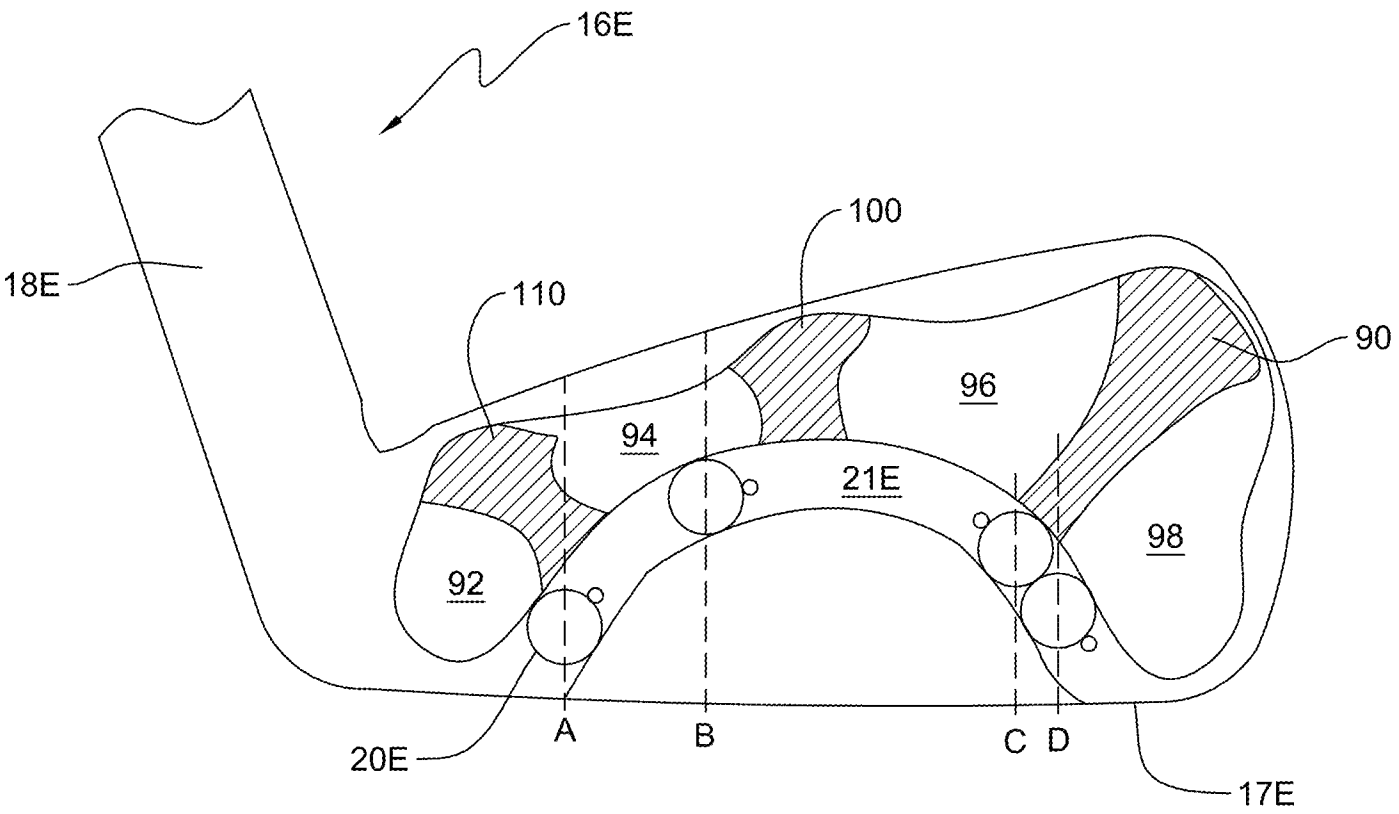
FIG. 10 is a partially cut away view of yet another embodiment of the invention, showing a possible track configuration in a vertical plain, in the shape of an arch, wherein a horizontal arch (not shown) is also achievable.

FIG. 10 illustrates a golf club 16E generally in the form of an iron, having a head 17E and shaft 18E. Head 17E has hollow portions 92, 94, 96 and 98, separated by shaped weights 90, 100 and 110. An arbitrary number of movable weights 20E, of the type illustrated in FIG. 5 (or of a type described elsewhere herein), may be moved and then secured in position along an arcuate channel 21E, having an associated track (not shown in FIG. 10 due to its cut away nature) at arbitrary positions along channel 21E. In FIG. 10, there are four weights 20E at positions corresponding to lines A, B, C and D. The arcuate nature of channel 21E, and the fact that in most irons, the surface of head 17E is at an acute angle with respect to the shaft 18E, causes the weights to effectively move in a three dimensional path from the toe to the heel of the head 17E. Advantageously, one or more weights may be positioned behind the ideal impact area or "sweet spot" of the face of the iron or putter.

Figure 11:
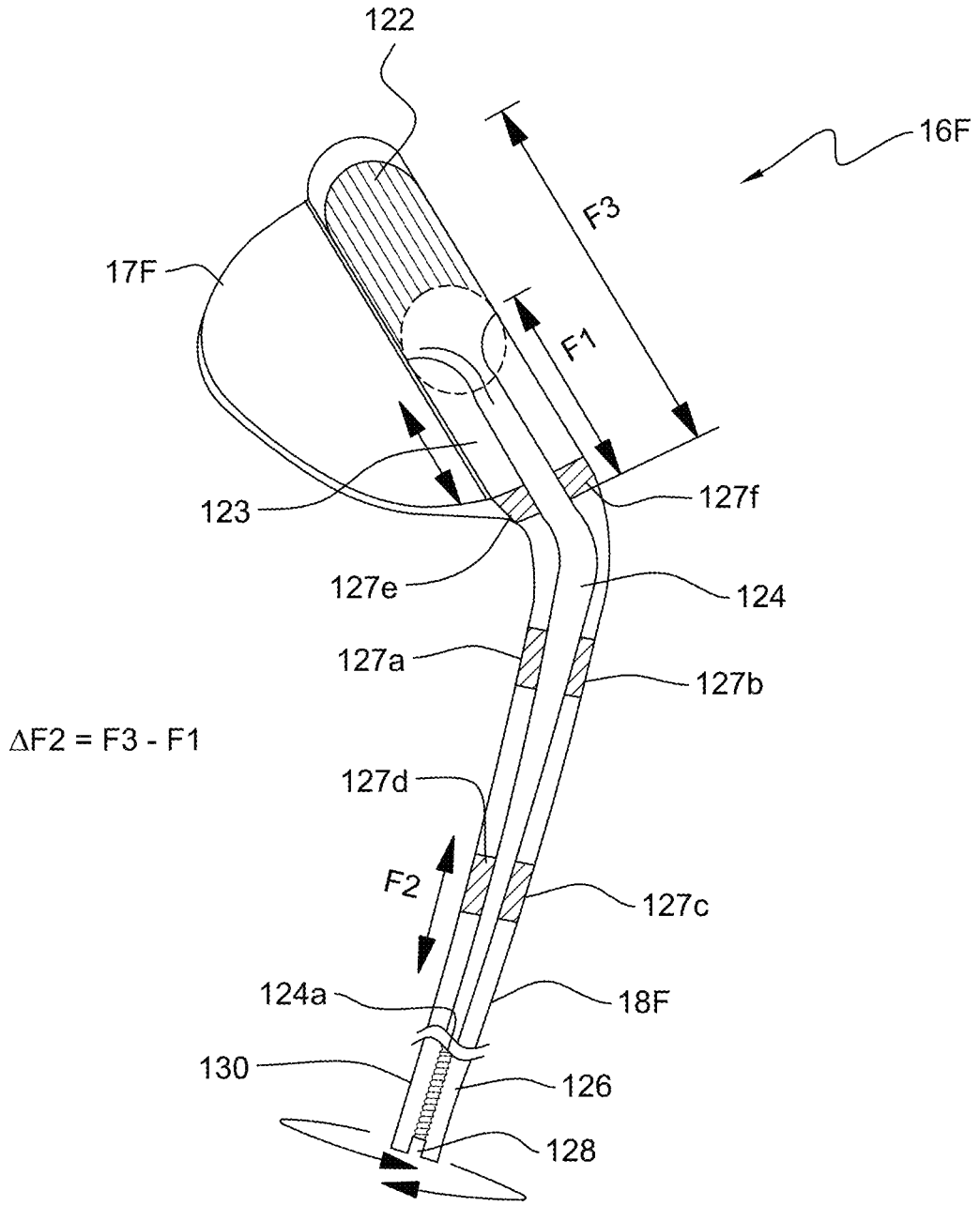
FIG. 11 is a second schematic illustration of a mechanism for adjusting the position of weights, similar to the embodiment of FIG. 10.

FIG. 11 is a schematic illustration of a mechanism for adjusting the position of weights. Golf club 16F has head 17F and shaft 18F. A weight 122 in a channel 123 within head 17F is connected to a flexible rod 124. A series of spacers 127*a*, 127*b*, 127*c*, 127*d*, 127*e* and 127*f* (six spacers are shown, but more may be placed along the interior length of shaft 18F) define a passageway within shaft 18F through which rod 124 may move. A knob 130 having a blind, threaded hole 126, accepts the threaded end 124A of rod 124. Knob 130 is fixed at the end of shaft 18F, but may rotate with respect to shaft 18F. A slot 128 may receive the blade of a screwdriver (not shown) to rotate knob 130. Such rotation causes the end of rod 124 to move into or out of knob 130 (depending on the direction of rotation), thus causing motion of weight 122 within channel 123 through a maximum distance:

$$\Delta F2 = F3 - F1, \text{ where:}$$

F3 is the length of channel 123, and F1 is the length of weight 122.

Channel 123 can be an arcuate channel, as in FIG. 10. Weight 122 may be an array of weights for movement along channel 123.

Figure 12:
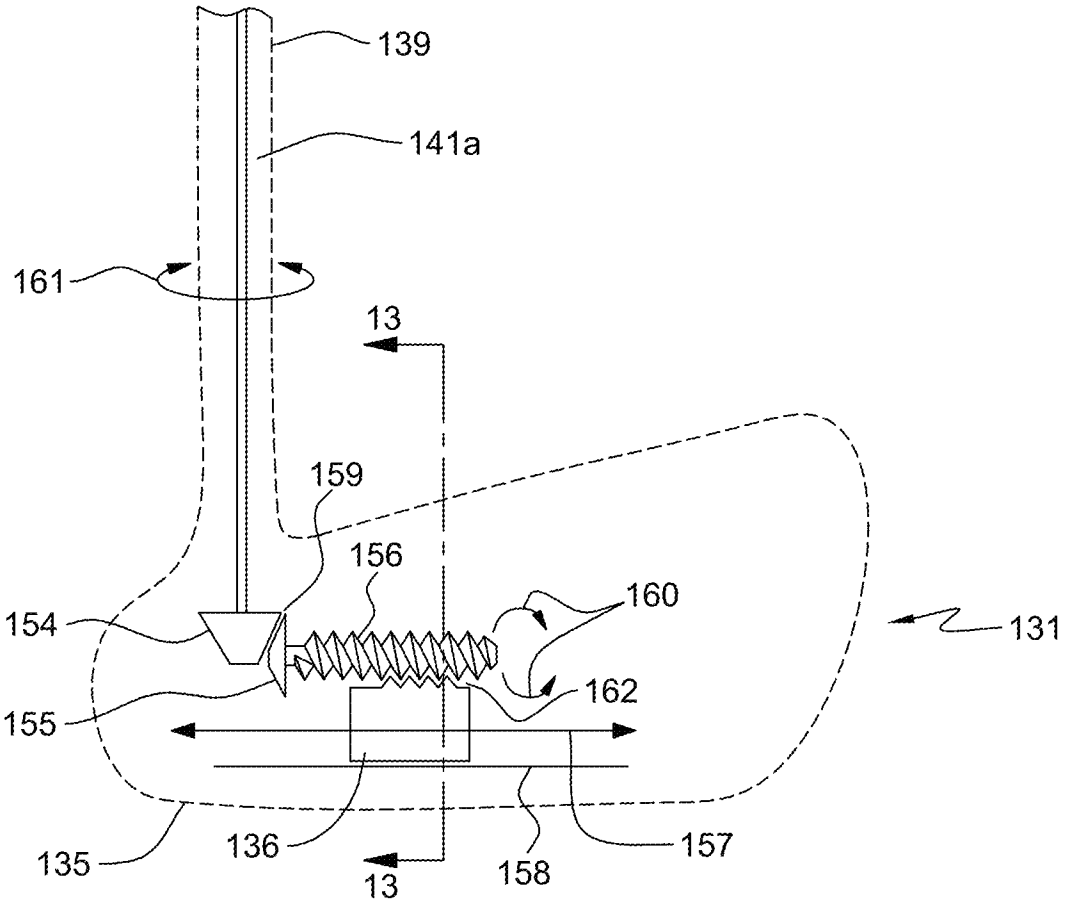
FIG. 12 is a cut away view of a third embodiment of a iron or putter in accordance with the invention.
Figure 13:
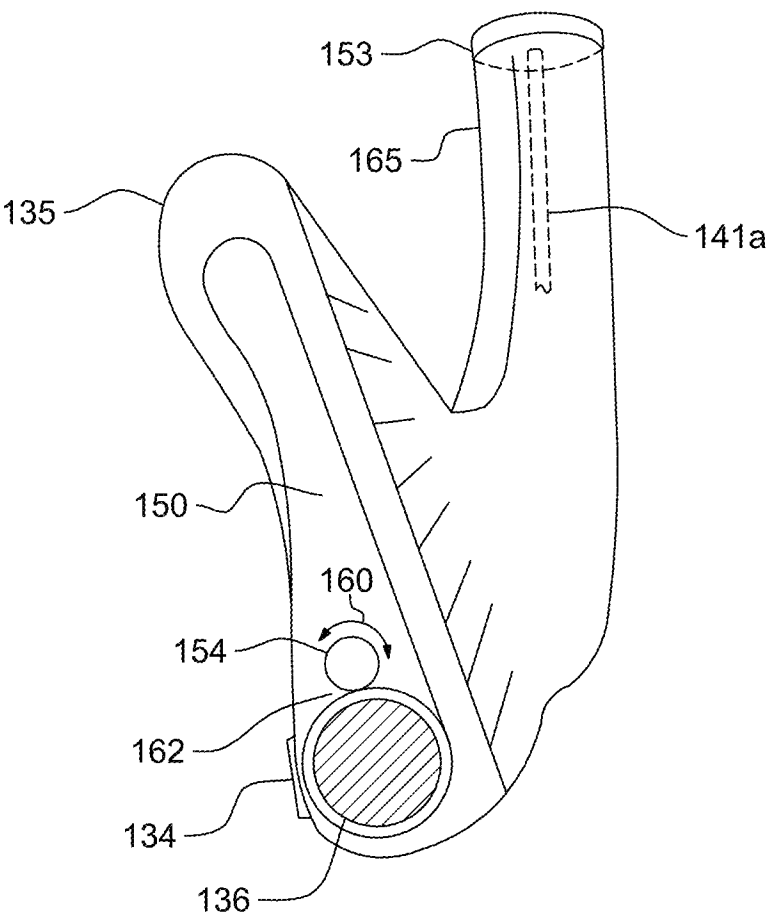
FIG. 13 is a cross-sectional view taken generally along line 13-13 of FIG. 12.

Referring to FIG. 12 and FIG. 13, an iron or putter shown generally as 131 has a head 135 and a shaft 139. A generally cylindrical weight 136 is designed to slide along the bottom 158 of a hollow portion 150 of head 135 in the directions indicated by arrow 157. Weight 136 is configured with thread like groves 162 which engage a worn gear 156, which is driven to rotate clockwise or counter clockwise, as indicated by the arrows 160, by a conical gear 155 at the end of worm gear 156. Conical gear 155 engages a conical gear 154, which is in turn caused to rotate by a rod 141*a*. Rod 141*a* may extend to the gripping portion of shaft 139, and be rotated clockwise or counterclockwise, as represented by arrow 161, to thus cause weight 136 to move within hollow portion 150 of head 135, in response to rotation of a knob as described with respect to FIG. 11, or other appropriate mechanism.

Figure 14:
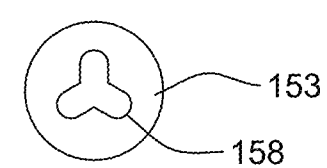
FIG. 14 is a top view of the hosel illustrated in FIG. 13.

Referring to FIG. 13 and FIG. 14, alternatively, the shaft 139 may be removed from the hosel 165 of head 135 to expose a disk 153 mounted for rotation when a key (not shown in FIG. 13) is inserted into an opening 158 in disk 153, and the key is rotated, thus changing the position of weight 136 within head 135. As a further alternative, a knurled edge of disk 153 may extend from a slot in hosel 165, allowing its rotation by the action of the finger of a user, without the need to remove shaft 139.

In general, it will be appreciated that the position of the weight 136 may be controlled from the shaft of the golf club, or the handle of the golf club. For example, in yet other embodiments, the shaft, or a handle portion of the shaft, may be rotated with respect to the head, in order to rotate a gear which changes the position of weight 136 within head 131. It is possible for the shaft to be configured at its bottom with teeth that engage a conical gear affixed to the worm gear, so that when a set screw is loosened, the shaft can rotate with respect to the head, and thus cause the position of the weight to change.

Figure 15:
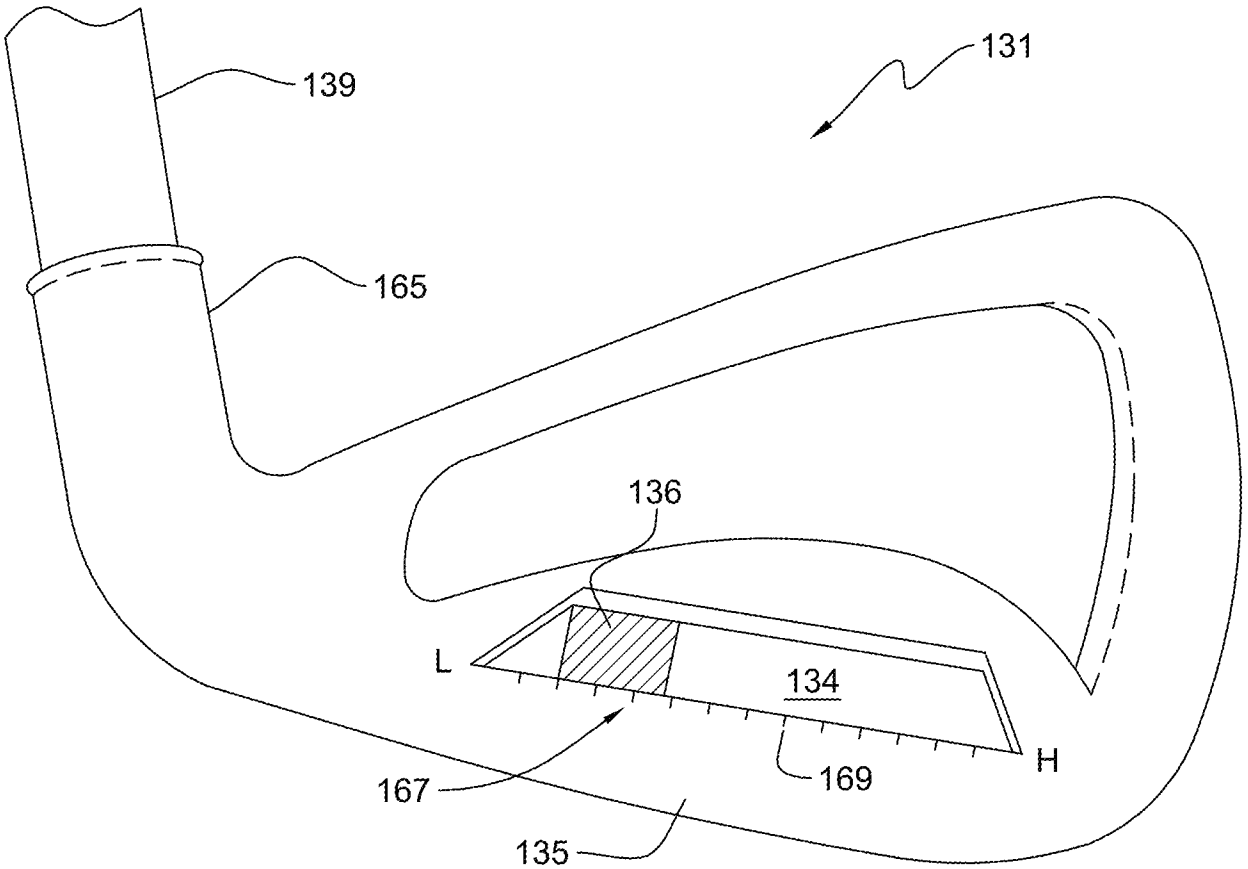
FIG. 15 is a back elevational view of, the embodiment of FIG. 13, illustrating another feature (transparent window) of the invention.

Referring to FIG. 13 and FIG. 15, a transparent window 134 may be provided to allow observation of the position of weight 136 as it is moved within head 135 between a position of low moment of inertia "L" to a position of high moment of inertia "H", along a scale 167 having markings 169. The window may also be translucent, as long as the position of the weight, of a suitable color, can be visualized. Alternatively, the window 134 may be opaque, if it can be removed for adjustment and inspection of the position of weight 136 within head 135.

Figure 16:
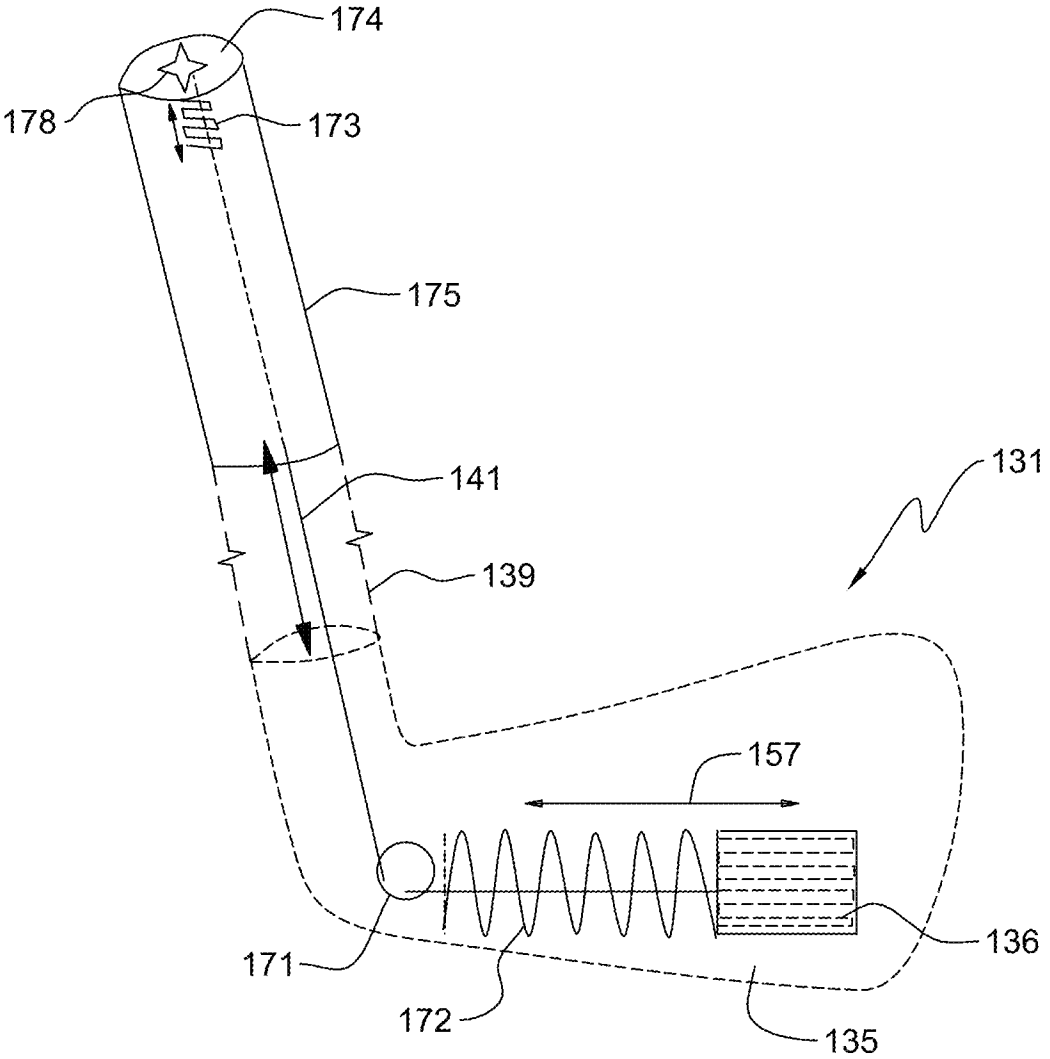
FIG. 16 is a schematic view of another embodiment of an iron or putter in accordance with the invention, which shows a spring actuated weight system.

In FIG. 16, weight 136 is urged into the high moment of inertia position by a spring 172. A wire 141, that loops around a pulley wheel 171, is connected to weight 136, and can be moved to thus move weight 136 by compressing or decompressing spring 172. The end of wire 141 not connected to weight 136 is connected to a take up mechanism 173, operated by a rotating disk 174, within shaft 139. Disk 174 may be rotated when a key (not shown in FIG. 16) is inserted into an opening 178 in disk 174, and the key is rotated, thus changing the position of weight 136 within head 135.

FIGS. 17A, 17B and 17C illustrate a key useful with the invention. The key has three portions for being received in three corresponding portions of a screw head associated with a weight for use on a golf club. The key may also be used to turn a screw or screws to remove and replace the removable cover of some of the embodiments of the invention illustrated herein.

Thus, in accordance with the invention, a golfer can utilize one or more variable or similar weights to achieve a desired equilibrium, COG, or moment of inertia while maintaining a constant or scalable mass. Moreover, the weights are engineered to be secured onto the complex surface/contour of the club head, thereby permitting the movement of one or more weights in a 2D or 3D (three dimensional) configuration. The invention also features one or more detachable plates/cover, which houses the various tracks containing the weights.

Generally speaking, the invention allows the COG to be directed as close as possible to the surface of the club (namely the sole [bottom] and the rear). The continuously variable positioning of weights provides a nearly infinite combination of COG/MOI configurations.

By being able to position the weights close to the perimeter (surface), the COG can be located/positioned close to the bottom (sole of the club). The unique design of the weight within the removable cover, and through the cover allows for the easy manipulation/adjustment and location of the spheres/weights. In addition, in accordance with the invention, the weights are positionable to the rear of the club (which again offers some advantages of COG) flexibility.

It should be understood that the foregoing description is only illustrative of the invention. Various alternatives and modifications can be devised by those skilled in the art without departing from the invention. Accordingly, the present invention is intended to embrace all such alternatives, modifications and variances that fall within the scope of the appended claims.

What is claimed is:

1. A golf club comprising:

a shaft;

a head having a channel therein;

at least one weight for positioning along said channel; and a mechanism for securing the at least one weight at arbitrary positions along said channel so as to customize at least one of center of gravity and moment of inertia of said head, said mechanism comprising:

a first portion for connection to said weight; and a second portion configured to move said first portion to move said weight.

2. The golf club of claim 1, wherein the second portion includes at least one component associated with said shaft.

3. The golf club of claim 1, wherein:

said first portion includes a flexible rod coupled to said weight and extending through said shaft; and said second portion includes a moving means for moving an end of said rod opposite to said at least one weight.

4. The golf club of claim 3, wherein said moving means comprises a rotatable knob having a threaded hole for receiving a threaded end of said rod opposite to said at least one weight.

5. The golf club of claim 1, wherein:

said first portion includes a wire or cable coupled to said weight at a first end; and said second portion includes a take up mechanism for taking up and releasing a portion of said wire or cable not coupled to said weight, further comprising:

a spring for urging said weight in a direction so as to keep tension in said wire or cable.

6. The golf club of claim 1, wherein said second portion comprises a disk rotatably mounted in a hosel of said head.

7. The golf club of claim 1, configured in the form of an iron.

8. The golf club of claim 1, configured in the form of a putter.

9. The golf club of claim 1, further comprising a window covering said channel, said window being transparent, translucent or opaque so that position of said weight along said channel may be observed through or by removing said window.

* * * * *